US005771874A

United States Patent [19]

Kohler

[11] Patent Number: 5,771,874

[45] Date of Patent: Jun. 30, 1998

[54] CLAY TARGET TRAPS

[76] Inventor: Ludwig Kohler, 33 Brushwood Drive, Alfords Point, Sydney, New South Wales, Australia, 2234

[21] Appl. No.: 810,999

[22] Filed: Feb. 27, 1997

[30] Foreign Application Priority Data

Feb. 27, 1996 [AU] Australia ..... PN8290

[51] Int. Cl.[6] ..... F41J 9/18

[52] U.S. Cl. ..... 124/8; 124/51.1; 124/82

[58] Field of Search ..... 124/8, 46, 47, 124/51.1, 82

[56] References Cited

U.S. PATENT DOCUMENTS

| | | | |
|---|---|---|---|
| 948,499 | 2/1910 | Clow | 124/8 |
| 1,071,512 | 8/1913 | Davey | 124/8 |
| 2,135,603 | 11/1938 | Roth | 124/8 |
| 3,937,203 | 2/1976 | Riedmueller et al. | 124/8 |
| 4,481,932 | 11/1984 | Olson | 124/8 |
| 5,406,928 | 4/1995 | Panara et al. | 124/8 |

FOREIGN PATENT DOCUMENTS

| | | | |
|---|---|---|---|
| 682533 | 3/1964 | Canada | 124/8 |
| 6800716 | 7/1968 | Netherlands | 124/8 |

*Primary Examiner*—John A. Ricci
*Attorney, Agent, or Firm*—Jacobson & Johnson

[57] ABSTRACT

There is a machine for launching clay shooting targets. The machine comprises a target storage magazine, a delivery plate adjacent the base of said magazine and a user controllable delivery mechanism adapted to unload either one or a pair of said targets from the magazine onto the plane of the delivery plate. There is a throwing arm adapted upon release to move across the delivery plate from a cocked position behind the targets to a discharged position so that the targets are catapulted into the air from the delivery plate. The leading edge of the throwing arm is curved so as to be in contact with or sufficiently closely adjacent the targets when in the cocked position to avoid target breakage upon release and also provide close flight trajectories for said pair of targets.

9 Claims, 5 Drawing Sheets

CLAY TARGET TRAPS

FIELD OF THE INVENTION

This invention relates to clay target traps.

BACKGROUND OF THE INVENTION

Clay target traps are machines which are used for launching specially shaped projectiles into the air for use in target shooting. Existing traps typically comprise a rotary magazine which carries a plurality of vertical stacks of target disks. The targets are deposited individually onto a delivery plate below the magazine from which they are catapulted into the air by a spring loaded throwing arm. The arm as well as imparting linear motion to the target disk also imposes a spin which improves flight stability. With most currently available traps the arm is cocked after each launch by a motorised mechanism. There are also motor mechanisms for adjusting the vertical and horizontal trajectory of the target flight path. While existing traps are generally satisfactory for launching single targets many competitions require the simultaneous launching of two targets and existing machines either are not capable of this or require the somewhat dangerous practice of hand loading the second target immediately before each launch. Moreover even with hand loading existing machines produce an unacceptably wide trajectory for the two targets.

SUMMARY OF THE INVENTION

It is therefore an object of this invention to ameliorate the aforementioned disadvantages and accordingly there is disclosed a machine for launching clay shooting targets, said machine comprising a target storage magazine, a delivery plate adjacent the base of said magazine, a user controllable delivery means adapted to unload either one or a pair of said targets from the magazine onto the plane of said delivery plate in a side by side configuration, a throwing arm adapted upon release to move across said delivery plate from a cocked position behind said targets to a discharged position whereby said targets are simultaneously catapulted into the air from said delivery plate, wherein a leading surface of said throwing arm is curved so as to be in contact with or sufficiently closely adjacent to said targets when in the cocked position to avoid target impact breakage upon release and also provide close flight trajectories for said targets.

Preferably said user operable delivery means comprises a pickup plate which upon activation by the user is adapted to lower said pair of targets through an aperture in the base of said magazine onto the plane of said delivery plate.

It is further preferred that said delivery means be also adapted to unload one or a pair of said targets at the option of the user.

BRIEF DESCRIPTION OF THE DRAWINGS

The currently preferred form of this invention will now be described with reference to the attached schematic representations in which.

DETAILED DESCRIPTION

Figure 1:
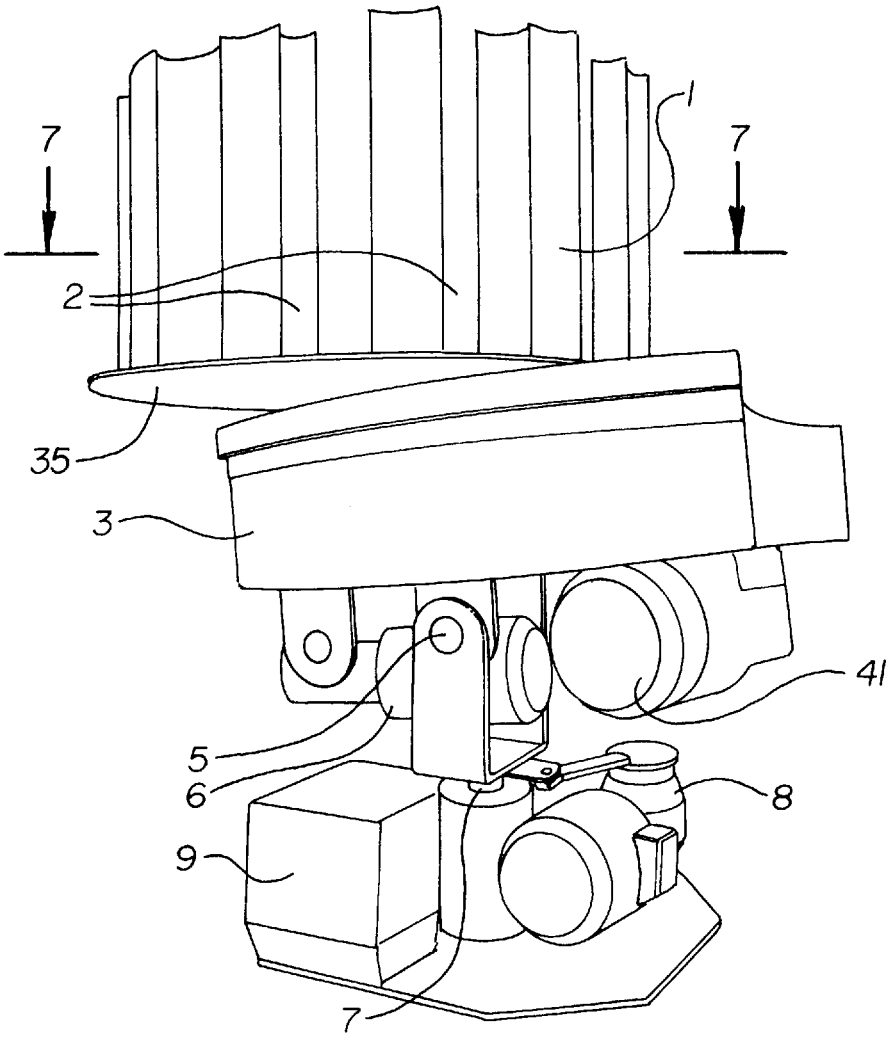
FIG. 1 shows a perspective view of a trap from one side.
Figure 2:
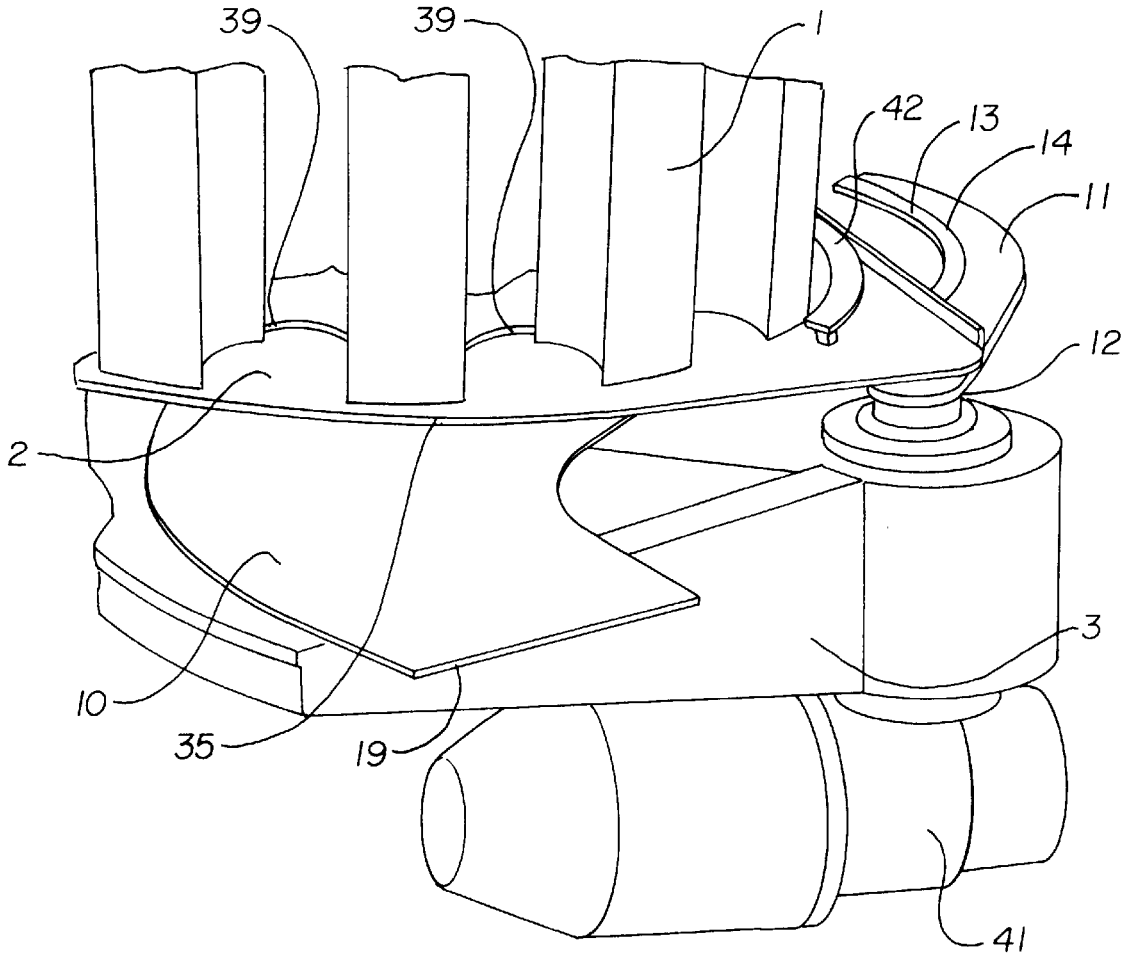
FIG. 2 shows a close up view of the pickup plate and throwing arm arrangement at the base of the magazine.

Referring first to FIGS. 1 and 2 the trap may comprise a rotary magazine 1 which carries stacks of clay target disks (not shown) in cells 2 around its periphery. The magazine is mounted on top of a chassis 3 having motorised tilt mechanisms for the adjusting of the vertical and horizontal trajectory of the launch. This is done by tilting the chassis 3 about horizontal axis 5 using a motor 6 or about vertical axis 7 using a second motor 8. These motors are operable separately through any suitable type of electrical control 9. As the construction described so far is typical of known prior art traps it will not be described in further detail.

Figure 3:
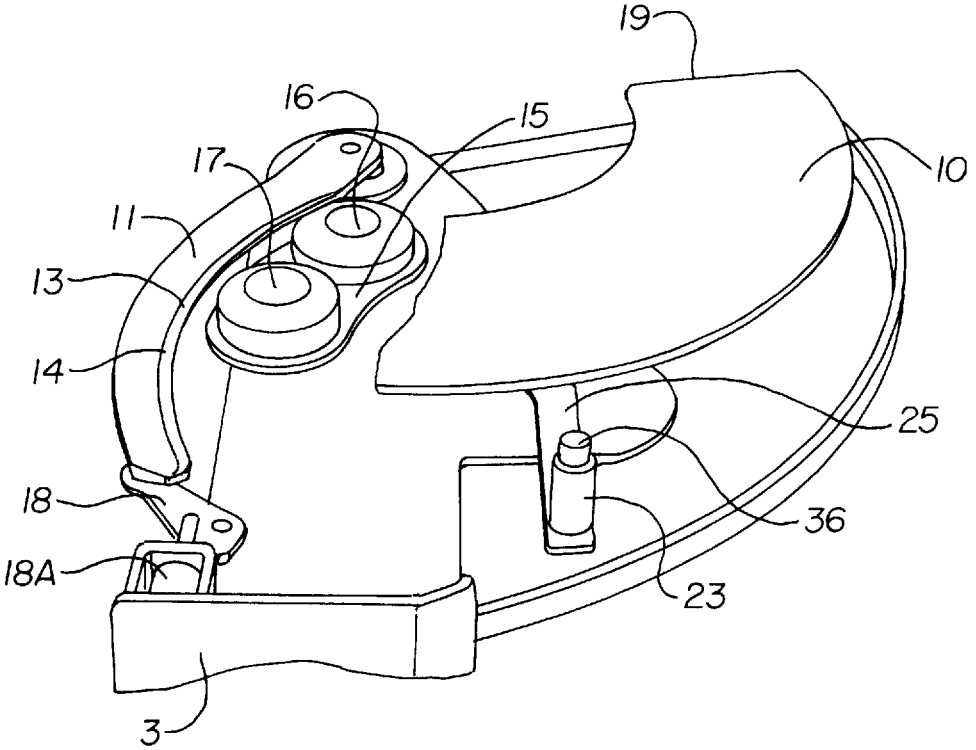
FIG. 3 shows the pickup plate, delivery plate and throwing arm in the cocked position with the magazine removed and two targets loaded for launching.

FIG. 2 shows a close up view of the delivery plate 10 located below the magazine 1. This plate is curved to generally follow a segment of the radial path of the throwing arm 11 about its axis 12 and extends out from under the magazine 1. In accordance with this invention and as best shown in FIGS. 2 and 3 the throwing arm 11 is curved at least along its leading edge 13 so as to provide a concave contact surface for the targets. With this embodiment the radius of curvature is 283 mm although this may be changed depending upon the size of the machine and the diameter of the targets used. Preferably this edge is also faced with a rubber strip 14 which sits within a recess in the blade. With the magazine 1 removed the arrangement of the throwing arm 11, delivery plate 10, and pickup plate 15 is shown in FIG. 3. The arm in its cocked position is located immediately behind either one or a pair of clay targets 16 and 17 which sit side by side on the pickup plate 15. The throwing arm is spring loaded (using any suitable means such as a coil spring) so that once the tip is released by rotation of the lug 18 using solenoid 18A it rotates about 300 degrees anticlockwise as shown across the surface of the delivery plate 10 to its discharged position with considerable speed and force. In doing so the targets 16 and 17 are launched off the edge 19 of the delivery plate 10. The targets due to centrifugal force also roll outwardly along the arm 11 during the launching action and due to the high friction coefficient of the rubber strip 14 a considerable degree of spin is imparted to them as they leave the trap. This stabilises and improves the flight characteristics. As best shown in FIG. 3 the curved nature of the arm also allows the edge 13 to abut or at least lie closely adjacent the peripheries of both targets 16 and 17 when in the cocked position. This minimises the initial impact loading on the frangible targets as the arm is released. With the straight throwing arms used in prior art machines the target positions shown here as they are unloaded from the rotary magazine would place the outside target 17 a significant distance from the edge of the throwing arm so as to cause a shattering upon engagement with the arm after its release. A still further advantage of the curved arm as discovered by the inventor is that the trajectories of the two targets when launched are substantially closer together due to their similar angle of flight when they disengage the arm.

Figure 4:
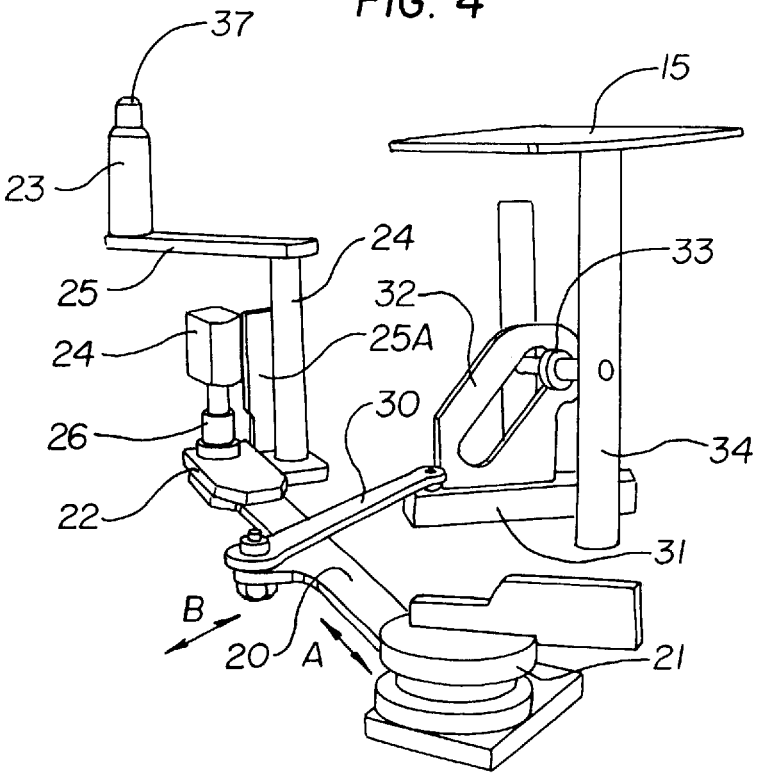
FIGS. 4 and 5 are perspective views of the delivery mechanism for unloading targets from the magazine onto the plane of the pickup plate.
Figure 5:
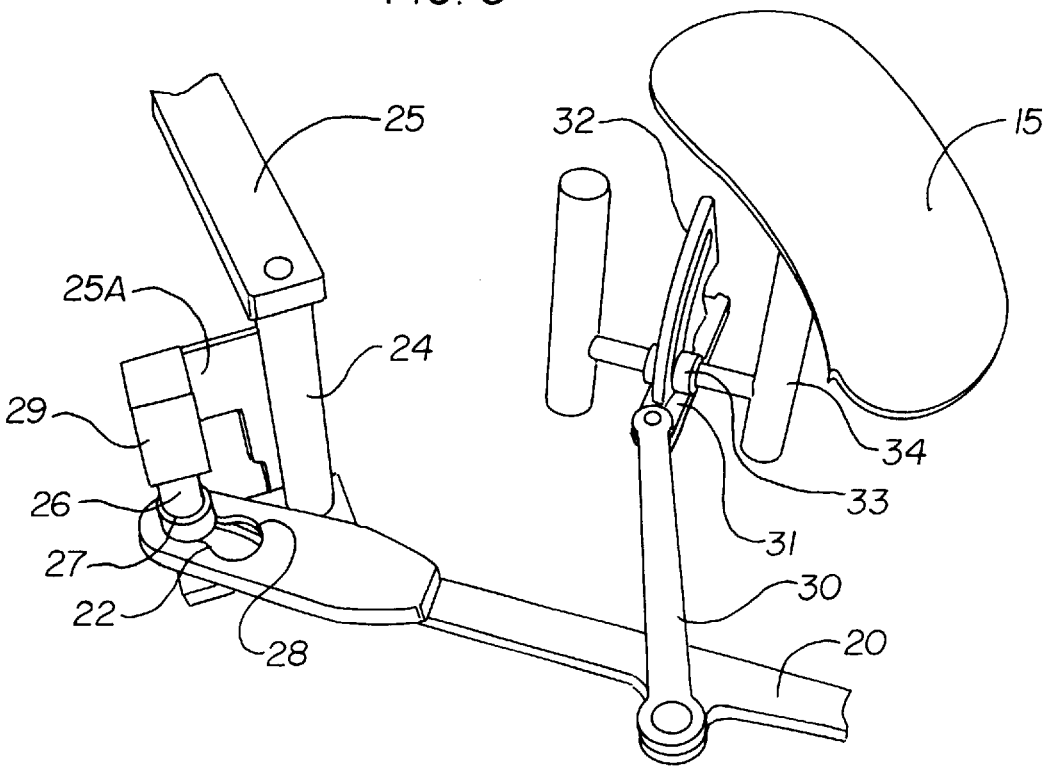
Figure 6:
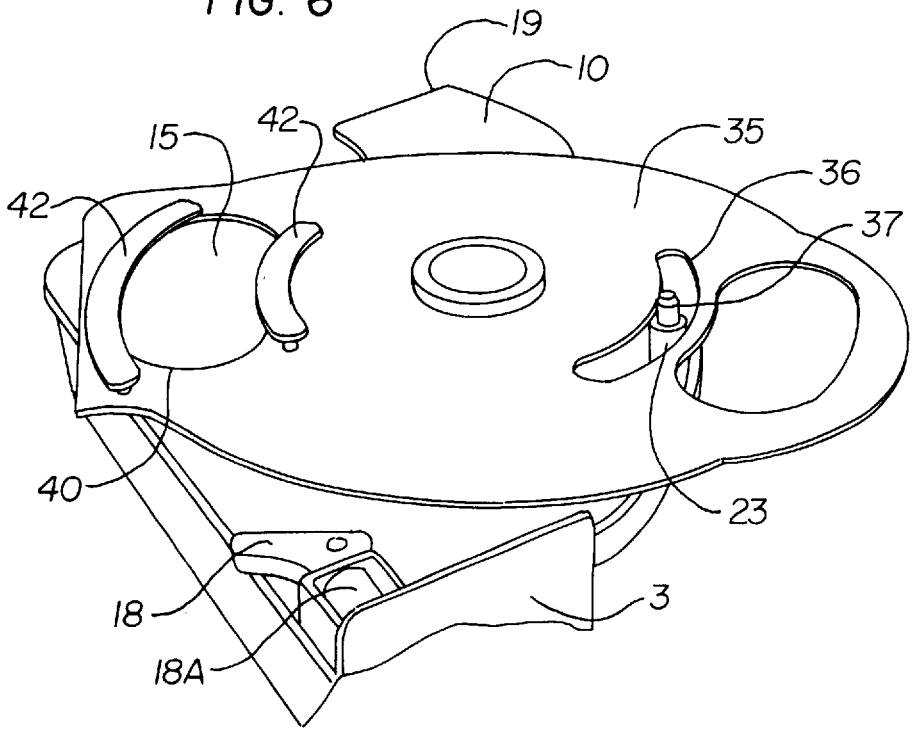
FIG. 6 shows the delivery mechanism at the base of the magazine.
Figure 7:
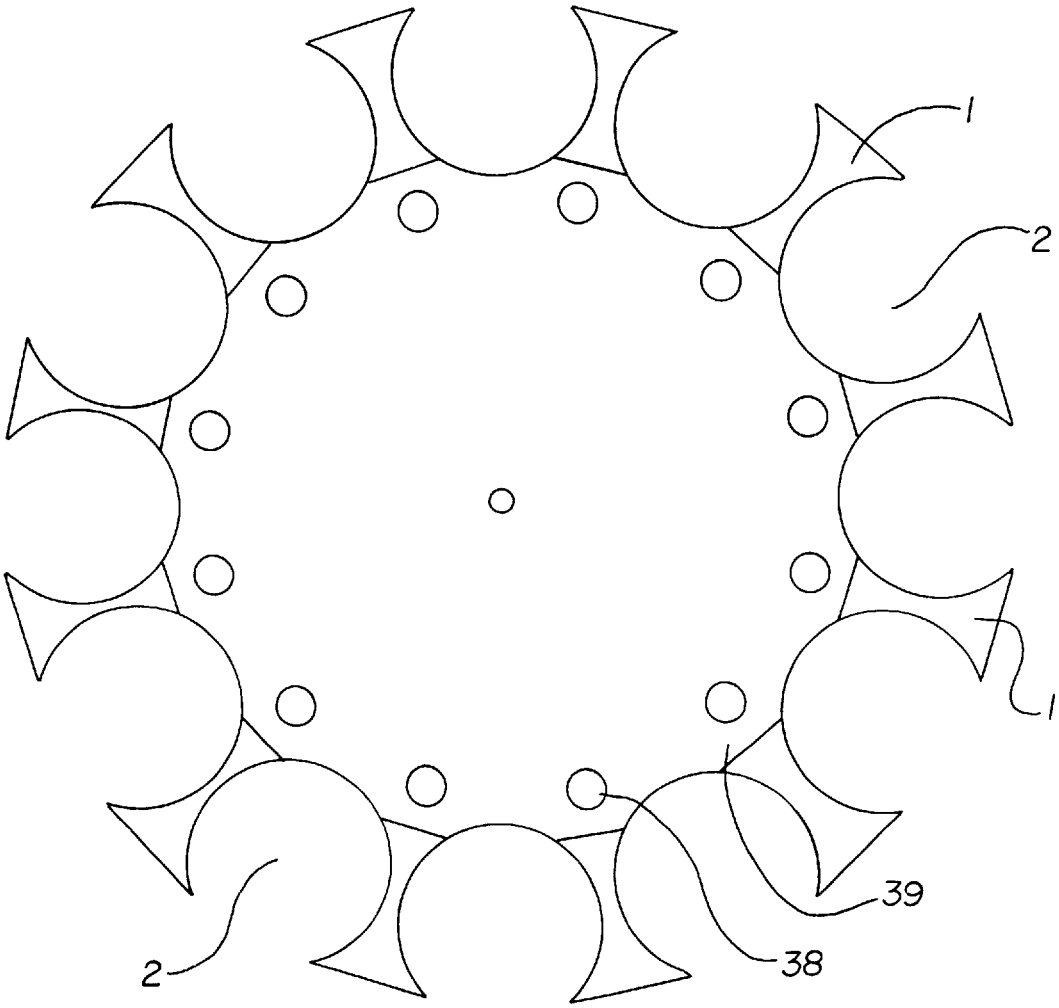
FIG. 7 is a cross-sectional view of the empty magazine frame along the lines A—A of FIG. 1.

The preferred delivery mechanism for unloading the targets from the magazine is shown separately in FIGS. 4 and 5. It comprises a main link 20 which extends between a motor driven eccentric crank arrangement 21 at one end and an elongated slot 22 formed at the other. Rotation of the crank 21 moves the link both lengthwise as shown by arrow "A" and transversely as shown by arrow "B". The lengthwise movement of the link 20 is transmitted to a vertical rod 23 by means of an axle 24, bar 25, connector plate 25A and pin 26 arrangement. The vertical position of the pin 26 within the slot 22 determines how much of this movement is transmitted. With the pin in its raised position as shown in FIG. 5 it is free to slide the length of the slot 22 and due to the resultant play in the mechanism only a reduced amount of movement is transmitted to the rod 23. With the pin 26 lowered however the enlarged portion 27 seats within an enlarged correspondingly shaped niche 28 at one end of the slot and virtually all play is thus eliminated so that the full motion of the main link 20 is transferred to the rod 23. The vertical position of this pin is preferably controlled by a solenoid 29 mounted to the plate 25A. Simultaneously with the movement of rod 23 a secondary link 30 extending out from the central portion of link 20 transmits transverse movement to a slide 31 and inclined slot member 32. A roller 33 extending out from a support pillar 34 for the pickup plate 15 runs within this slot 32. It will thus be appreciated that as the crank 21 is rotated the delivery mechanism shown provides a coordinated vertical movement of the pickup plate 15 and transverse movement of the rod 23. This linkage sits within the chassis 3 of the trap below the pick up plate 15 and magazine 1 as best shown in FIG. 6. The base plate 35 of the magazine has a curved slot 36 through which a bevelled spring loaded lug 37 on the end of the rod 23 protrudes to engage in apertures 38 in the magazine frame 39 (see FIG. 7) and the pickup plate 15 is located under a corresponding cutout 40 in this base plate 35. As motor drive 41 rotates the crank 21 the magazine is rotated by rod 23 either one or two cell spaces depending upon the selected position of the pin 26 so as to bring either one or two adjacent stacks of targets over the cutout 40. The spring loaded lug 37 ensures that the movement of rod 23 only engages the magazine for clockwise movement as shown. Flanges 42 on each side of the cutout 40 enter grooves between the stacked targets and isolate the lowermost target so that it is transported down to the plane of the delivery plate 10 (see FIG. 3) as the pickup plate 15 is subsequently lowered. Following release of the cocked throwing arm 11 the procedure is repeated. Preferably as with prior art machines the throwing arm 11 turns on a one way bearing and is cocked after each throw also by the motorised drive 41.

It will thus be appreciated that this invention at least in the form of the embodiment disclosed comprises a novel and unique improvement in target traps. Clearly however the example described is only the currently preferred form of this invention and a wide variety of modifications may be made which would be apparent to a person skilled in the art. For example the design of the housing for the trap and the controls used for the motorised drives may be modified according to application.

What is claimed is:

1. A machine for launching clay shooting targets, said machine comprising a target storage magazine, a delivery plate adjacent the base of said magazine, a user controllable delivery means adapted to unload either one or a pair of said targets from the magazine onto the plane of said delivery plate in a side by side configuration, a throwing arm adapted upon release to move across said delivery plate from a cocked position behind said one or pair of targets to a discharged position whereby said one or pair of targets are catapulted into the air from said delivery plate, wherein a leading edge of said throwing arm is curved so as to be in contact with or sufficiently closely adjacent said one or pair of targets when in said cocked postion to avoid target impact breakage upon release and also provide close flight trajectories for said pair of targets.

2. The machine as claimed in claim 1 wherein said user operable delivery means comprises a pickup plate which is adapted to lower said one or pair of targets through an aperture in the base of said magazine onto the plane of said delivery plate.

3. The machine as claimed in claim 2 wherein the leading edge of said throwing arm is faced with rubber or other material having a high friction coefficient.

4. The machine as claimed in claim 3 wherein said delivery means comprises a main link which extends between a motor driven eccentric crank at one end and an elongated slot at the other, whereby rotation of said crank moves the link both lengthwise and transversely, the lengthwise movement of said link being transmitted to a vertical rod by means of a pin in said elongated slot and the vertical position of said pin within said slot determining the amount of said lengthwise movement being transmitted.

5. The machine as claimed in claim 4 wherein when said pin is in a raised position reduced lengthwise movement is transmitted to the vertical rod to enable only said one target to be lowered onto the plane of said delivery plate and when said pin is in a lowered position increased lengthwise movement is transmitted to the vertical rod to enable said pair of targets to be lowered onto the plane of said delivery plate.

6. The machine as claimed in claim 5 wherein a spring loaded lug is located at the top of said vertical rod which engages said magazine for rotational movement.

7. The machine as claimed in claim 6 wherein when said pin is in the raised position said pin is free to slide the length of said slot and when said pin is in said lowered position an enlarged portion of said pin seats in an enlarged correspondingly shaped niche at one end of said slot so that said pin is not free to slide the length of said slot.

8. The machine as claimed in claim 7 wherein the position of said pin is controlled by a solenoid.

9. The machine as claimed in claim 8 wherein a secondary link extends out from the central portion of said main link which transmits the transverse movement of said main link to a slide and inclined slot member, and a roller running in said slot translates said transverse movement to vertical movement for said pickup plate which coordinates with the movement of said vertical pin.

* * * * *